United States Patent [19]

Patterson

[11] 3,975,488

[45]*Aug. 17, 1976

[54] PROCESS FOR PREPARING POLY(TETRAMETHYLENE TEREPHTHALATE) YARN

[75] Inventor: Joseph H. Patterson, Charlotte, N.C.

[73] Assignee: Fiber Industries, Inc., Charlotte, N.C.

[ * ] Notice: The portion of the term of this patent subsequent to July 2, 1991, has been disclaimed.

[22] Filed: Apr. 19, 1974

[21] Appl. No.: 462,272

Related U.S. Application Data

[63] Continuation-in-part of Ser. No. 299,978, Oct. 24, 1972, Pat. No. 3,822,334, which is a continuation of Ser. No. 48,483, June 22, 1970, abandoned.

[52] U.S. Cl. ..... 264/210 F; 264/290 T

[51] Int. Cl.[2] ..... D01D 5/12

[58] Field of Search ..... 264/210 F, 290 T

[56] References Cited

UNITED STATES PATENTS

| | | | |
|---|---|---|---|
| 2,465,319 | 7/1949 | Whinfield et al. | 260/75 R |
| 3,361,859 | 1/1968 | Cengato | 264/210 F |
| 3,553,305 | 1/1971 | Bu | 264/210 F |
| 3,715,421 | 2/1973 | Martin et al. | 264/210 F |
| 3,822,334 | 7/1974 | Patterson et al. | 264/210 F |

*Primary Examiner*—Jay H. Woo

*Attorney, Agent, or Firm*—Herbert M. Adrian, Jr.

[57] ABSTRACT

There is provided a process for preparing yarn comprised of at least 85 percent (by weight) of poly(tetramethylene) terephthalate with a spun denier per filament of from about 0.6 to about 50 from a polymer with a relative viscosity of from about 10 to about 50. In said process filaments of said polymer are extruded through a spinnerette at a spinning temperature of from about 240 to about 280 degrees centigrade, and the extruded filaments are taken up at a windup speed of from about 1000 to about 10,000 feet per minute; during said extrusion, the spinning threadline tension per extruded filament (as measured about 70 inches from the face of the spinnerette) is at least 0.09 grams per filament. Thereafter the extruded filaments are drawn in one or more stages to a draw ratio of from about 1.0 to about 5.0 and, during the drawing step, the filaments are passed over a heated object at a temperature of from about 60 to about 180 degrees centigrade.

4 Claims, No Drawings

PROCESS FOR PREPARING POLY(TETRAMETHYLENE TEREPHTHALATE) YARN

This is a continuation-in-part of Ser. No. 299,978 filed Oct. 24, 1972, now U.S. Letters Pat. No. 3,822,334, which in turn is a continuation of Ser. No. 48,483 filed June 22, 1970, now abandoned.

Poly(tetramethylene)terephthalate yarn is very useful because of its excellent tensile and dyeability properties. This invention relates to a novel process for spinning and drawing a yarn comprised of at least 85 percent (by weight) of poly (tetramethylene) terephthalate.

In the normal processing of melt spun polymers, to fibers, it is desirable to keep the tension in the spinning threadline as low as possible and still wind the material onto a package; for the use of low tensions improves uniformity and keeps spun orientation low, and low spun orientation allows relatively large draw ratios and increased productivity. A typical prior art teaching to this effect may be found, e.g., in U.S. Pat. No. 3,361,859.

It has been discovered that, unexpectedly, polymer comprised of at least 85 percent (by weight) of poly(-tetramethylene) terephthalate cannot be processed in accordance with the conditions taught by the art for the processing of, e.g., poly(ethylene) terephthalate polymer. When the former polymer is melt spun under conditions (adjusted for differences in melting points) normally used for the latter polymer, e.g., the yarn produced crystallizes on the package, causing filament growth and eventual sloughing from the package. Such a spun package can be processed further only with extreme difficulty and tedious handling. If the material is carefully handled and attempts are made to complete the drawing process, the spun yarn elongates when heated. Hot feed roll drawing is then impossible because the threadline licks back to the hot roll and entanglement ensues, causing a catastrophic threadline breakage. The use of a cold feed roll alone is restricted to low draw ratio processes (less than about 1.6) as cold drawing at higher ratios leads to thick and thin portions in the yarn and a nonuniform product. Other drawing methods such as steam jets or hot air drawing require special equipment and are inconvenient on a large scale; the use of steam jets, e.g., is disadvantageous because it is expensive, generates heat and noise, and crystallizes the yarn to a point where it cannot be textured effectively; the use of a hot shoe, e.g., makes the process very difficult to run. The addition of a steam conditioning tube at spinning will prevent crystallization on the bobbin, but it does not necessarily allow the material to be drawn from a hot feed roll.

It is thus an object of this invention to provide a simple, economical process for spinning and drawing polymer comprised of at least 85 percent (by weight) of poly(tetramethylene) terephthalate into yarn. In accordance with this invention, there is provided a process for preparing yarn comprised of at least 85 percent (by weight) of poly(tetramethylene) terephthalate with a total spun denier of from about 80 to about 700 from polymer, comprising the steps of sequentially:

1. preparing a polymer comprised of at least 85 percent (by weight) of poly(tetramethylene)terephthalate wherein said polymer has a relative viscosity of from about 10 to about 50;

2. extruding from about 5 to about 70 filaments of said polymer through a spinnerette, wherein:
   a. the spinning temperature is from about 240 to about 280 degrees centigrade, and
   b. the extruded filaments are taken up at a windup speed of from about 1000 to about 10,000 feet per minute; and 3. thereafter drawing said filaments to a draw ratio of from about 1.0 to about 5.0, said filaments being passed over a heated feed roll at a temperature of from about 60 to about 180 degrees centigrade during said drawing step;

provided that, during said extrusion step, the spinning threadline tension per extruded filament (as measured about 70 inches from the face of the spinnerette) is at least 0.09 grams per filament, and the total spinning threadline tension (i.e., the tension on the yarn bundle) is at least $-0.4 + 0.00174$ (total spun denier of yarn) + 0.052 (relative viscosity of polymer) − 0.0366 (spinning temperature, in degrees centigrade) + 0.1414 (number of filaments extruded) + 0.00381 (windup speed) − 0.000000332 (windup speed)$^2$.

It has been discovered, quite unexpectedly, that the use of the relatively high spinning threadline tension in conjunction with the other process parameters described herein produces a yarn with excellent tensile and dyeability properties and good uniformity. The product produced by applicant's process has good uniformity even at high windup speeds; this is rather unobvious in view of the performance of poly(ethylene)-terephthalate wherein the quality of the yarn produced decreases markedly with an increase in windup speeds. Thus applicant's process is nonanalogous to processes for the preparation of poly(ethylene) terephthalate in at least two respects: it uses relatively high spinning threadline tensions, and it uses relatively high windup speeds. These features would produce a poly(ethylene) terephthalate yarn with inferior properties were they to be used to spin and draw poly (ethylene) terephthalate; but they produce a poly (tetramethylene) terephthalate yarn with excellent properties.

In the process of this invention the polymer which is spun and drawn into yarn is comprised of at least 85 percent (by weight) of poly (tetramethylene) terephthalate. It may be prepared by reacting terephthalic acid or its dialkyl ester and a polymethylene glycol having the formula $$HO(CH_2)_nOH$$

wherein $n$ is an integer from 2 to 8. At least 85 percent of said polymer is prepared from a glycol wherein $n$ is 4(1,4-butanediol), and some or all of the remaining 15 percent may be prepared from ethylene glycol, trimethylene glycol, 1,4butanediol, and the like. The polymethylene glycol used to prepare some or all of said remaining 15 percent may be replaced entirely or in part with other glycols such as 1,4-cyclohexanedimethanol; 1,4-bis-(2-hydroxyethyloxy) benzene, and the like. It is preferred that no more than about 10 percent of the polymer will be prepared from a glycol which is not a polymethylene glycol.

Other dicarboxylic acids and their esters may be used to prepare the polymer used in the process of this invention. Thus, e.g., from about 1 to about 10 weight percent (based on the weight of the terephthalic acid or the dialkyl ester thereof used to make the polymer) of a dicarboxylic acid selected from the group consisting of HOOC - R - COOH, 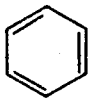 , and 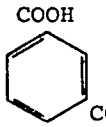

wherein R is alkylene of from about 2 to about 16 carbon atoms may be used. When said dicarboxylic acid is used in the preparation of said polymer, it is preferred to use from about 3 to about 8 weight percent this said thereof. Some of the dicarboxylic acids which may be used to prepare the polymer used in the process of this -butanediol; include, e.g., succinic acid, glutaric acid, adipic acid, pimelic acid, suberic acid,, azelaic acid, sebacic acid, phthalic acid, isophthalic acid, and the like. When one or more of said dicarboxylic acids is used, it is preferred that they be of the formula HOOC-R'-COOH wherein R' is alkylene of from about 4 to about 10 carbon atoms; and it is most preferred that R' be alkylene of 4 carbon atoms.

Subject to the limitation described above (viz., at least 85 weight percent of the polymer is polytetramethylene terephthalate), the polymer used in the process of this invention may be comprised of other compounds than the ones hereinbefore described such as, e.g., dye site additives, delustrants, antistatic agents, optical brighteners, etc.

In a preferred embodiment, the polymer used in the process of this invention essentially consists of poly (tetramethylene) terephthalate, i.e., at least 95 percent (by weight) of the polymer is poly (tetramethylene) terephthalate.

In the process of this invention it is preferred to prepare yarns with a "total" denier (or a "total spun denier") of from about 80 to about 700. "Total denier" (or "total spun denier") is the weight (in grams) of 9000 meters of yarn. It is preferred that the total spun denier of the yarn made in the process of this invention be from about 100 to about 550, and it is most preferred that said total spun denier be from about 150 to about 450.

Processes for the preparation of poly (tetramethylene) terephthalate polymer are well known to the art. Thus, e.g., one may prepare said polymer by reacting terephthalic acid and one may prepare said polymer by reacting terephthalic acid and 1,4-butanediol as disclosed in U.S. Pat. No. 2, 465,319; this is a "direct esterification" method. Alternatively, one can prepare said polymer by reacting, e.g., dimethyl terephthalate and 1,4butanediol; this is the "ester-interchange" process. The "relative viscosity" (i.e., the ratio of the viscosity of an 8 percent solution of polytetramethylene terephthalate in orthochlorophenol to the viscosity of the orthochlorophenol per se measured in the same units at 25° centigrade) of the polymer used in the process of this invention should be from about 10 to about 50, although it is preferred to work with a polymer with a relative viscosity of from about 15 to about 40, and it is most preferred to work with a polymer with a relative viscosity of from about 20 to about 30.

In the process of this invention from about 5 to about 70 filaments of said polymer are extruded through a spinnerette at a spinning temperature of from about 240 to about 280° centigrade ("spinning temperature" is the temperature of the molten polymer before extrusion), and the extruded fiber is taken up at a "windup speed" of from about 1000 to about 10,000 feet per minute. It is preferred to extrude from about 10 to about 50 filaments of said polymer at a spinning temperature of from about 245 to about 270° centigrade and take up the extruded filaments at a windup speed of from about 2500 to about 6000 feet per minute. In the most preferred embodiment of this invention from about 15 to about 40 filaments of said polymer are extruded at a spinning temperature of from about 250° to about 265° centigrade and taken up at a windup speed of from about 3000 to about 5000 feet per minute.

In the process of this invention, it is critical that the spinning threadline tension (as measured about 70 inches from the face of the spinnerette) be at least 0.09 grams per filament, and it is preferred that it be at least 0.19 grams per filament. The total spinning threadline tension (i.e., the tension on the yarn bundle, as distinguished from the tension on the individual filaments comprising the yarn bundle) is at least equal to $-0.4 + 0.00174$ (total spun denier of yarn) $+ 0.052$ (relative viscosity of polymer) $-0.0366$ (spinning temperature, in degrees centigrade) $+ 0.1414$ (number of filaments extruded) $+ 0.00381$ (windup speed) $- 0.000000332$ (windup speed)$^2$.

After the extruded filaments are taken up, they are drawn to a draw ratio of from about 1.0 to about 5.0, although it is preferred to draw them to a draw ratio of from about 1.5 to about 4.5; and this can be done in one or two stages, depending upon the conditions employed. A two stage draw operation is preferred if the equation specified below yields a value of 1.000 or more. If $1.603 - 0.0000174$ (windup speed) $+ 0.0001336$ (spinning temperature in degrees centigrade) $+ 0.003863$ (feed roll temperature, in degrees centigrade) $-0.02377$ (relative viscosity of polymer) $+ 0.0006562$ (number of filaments extruded) $- 0.0919$ (feed roll temperature/relative viscosity) exceeds 1.000, then a two stage draw should be used; if it is less than 1.000, it is preferred to use a one stage draw.

If a two stage draw is used, the first stage is conveniently a cold "draw" step wherein the material is drawn to a draw ratio of from about 1.0 to about 1.6 (and preferably from about 1.0 to about 1.2) while being passed over a "cold" feed roll which is at a temperature of from about ambient up to about 60° centigrade. The second stage is a "hot draw" wherein the material is drawn over a hot feed roll at a temperature of from about 60 to about 180° centigrade to a total draw ratio of from about 1.0 to about 5.0. As with the one-stage draw process, in the two stage process it is preferred that the total draw ratio be from about 1.5 to about 4.5 and that the second stage feed roll temperature be from about 70 to about 150° centigrade, and it is most preferred to have said second stage feed roll temperature be from about 80° to about 130° centigrade. The draw speed in the "hot draw" step may be from about 500 to about 10,000 feet per minute. Inasmuch as applicant's process relates to one and two stage drawing steps, the latter using a cold draw, it will be appreciated that when applicant uses the term " . . . said filaments being passed over a heated feed roll at a temperature of from about 60° to about 180° centigrade during said drawing step" to describe his invention the term "during" describes the use of the heated feed roll at a temperature of from about 60° to about 180° centigrade for either part of (two stage draw) or essentially all of (one stage draw) the drawing step.

If the aforementioned equation yields a value which is less than 1.000 and if the spinning threadline tension is at least 0.19 grams per filament and at least equal to 0.16 + 0.0005 (feed roll temperature degrees C) grams/filament, a one stage "hot draw" may be employed; and this is the preferred method of drawing. When the one-stage draw is used, the filaments are passed over a heated object such as a heated feed roll or a hot pin or a hot plate at a temperature of from about 60° to about 180° centigrade during the drawing, although it is preferred to use a heated feed roll at a temperature of from about 70° to about 150° centigrade, and it is most preferred to have the feed roll at a temperature of from about 80° to about 130° centigrade. In this one stage hot draw the filaments are drawn to a draw ratio of from about 1.0 to about 5.0, although it is preferred to use a draw ratio of from about 1.5 to about 4.5.

The yarn produced via the process of this invention, when made into fabric, gives a fabric with excellent hand (softer than comparable fabric made from polyethylene terephthalate), dye uptake, and dye uniformity.

In the process of this invention it is preferred to prepare drawn yarns which have a denier per filament ("dpf") of from about 0.6 to about 10, although it is more preferred that the dpf of said yarns be from about 1 to about 8 and it is most preferred that said dpf be from about 1.2 to about 6.5. This represents a range of undrawn deniers per filament, i.e. spun dpf, of about 0.6 to about 50 at draw ratios of 1.0 to 5.0 or more preferably, about 1.8 to 45 at preferred draw ratios of 1.5 to 4.5.

The hole size of the spinnerettes through which the poly (tetramethylene) terephthalate polymer is extruded may be from about 0.005 to about 0.050 inches in diameter. Unlike the case with poly (ethylene) terephthalate extrusion, wherein spun birefringence goes up and draw ratios decrease markedly as hole size is increased, Uster values, cross section coefficients of variation, birefringence, and maximum draw ratios are essentially the same for poly (tetramethylene) terephthalate filaments which are spun and drawn at the same spinning temperature and windup speed to the same denier per filament regardless of the hole size employed.

In the process of this invention, as the poly (tetramethylene) terephthalate polymer is being extruded into filaments, the extruded filaments may be quenched by any of the methods well known to the art. Thus, e.g., they may be quenched by water, by air blown onto the filaments, etc. When a quench system is used, it is preferred for reasons of simplicity and economy to use an air flow quench system wherein air is blown over the extruded polymer. It has been discovered that when such a system is used with poly (tetramethylene) terephthalate made, e.g., in accordance with Example 1 of this specification there is a certain optimum quench rate for any one set of spinning conditions at which spun yarn orientation is at a minimum. Under otherwise constant spinning conditions, spun yarn orientation decreases to a minimum with increasing quench air flow, and as the quench rate is further increased spun orientation increases. Thus, e.g., in one experiment, yarns with a spun denier of 400 were extruded, wound up at a speed of 4000 feet per minute, and drawn to a draw ratio of 2.5. The elongations to break of the resulting products were determined, and these are indicated below.

| Velocity of Air (Outflow), Feet/Minute | Elongation To Break of Product |
|---|---|
| 0 | 25% |
| 26 | 30% |
| 50 | 36% |
| 80 | 44% |
| 96 | 40% |

This discovery has two important implications from a process standpoint: for a given spinning process, there is an optimum quench air flow rate for maximum productivity; and since the birefringence versus quench air flow curve reaches a minimum at this point, the process becomes less sensitive to small variations in quench rate so that a more uniform product should result.

The following Examples are presented to illustrate applicant's invention but are not to be deemed limitative thereof. Unless otherwise stated, all parts are by weight and all temperatures are in degrees centigrade.

EXAMPLE 1

0.2 moles of purified diphenyl silanediol are placed in a vessel equipped with a stirrer, an additional funnel, and a short distillation column connected to a vacuum system. 0.4 moles of tetraisopropyl titanate are added in a period of 2 minutes. An exothermic reaction results. The reactants are gently heated to 65° centigrade under constant stirring. The condensation product, isopropyl alcohol, is removed quantitatively under reduced pressure (300 millimeters of mercury absolute) in a period of 3.5 hours. A viscous, slightly cloudy, tan colored liquid product is obtained in 98 percent yield. The product produced by this reaction as well as the use thereof as a catalyst is the sole invention of Luis R. Vizurraga and was not invented by Joseph Patterson.

25 pounds of dimethyl terephthalate and 16.2 pounds of 1,4-butanediol are charged to a melter and liquefied, thereby forming a solution wherein the 1,4-butanediol/dimethyl terephthalate mole ratio is 1.4/1.

The solution is then transferred to an ester-interchange vessel equipped with a stirrer and a condensation system for the separation of distillates. 11.4 grams of the compound produced as described above are added to the solution. The reaction mixture is then heated up to a temperature of 224° centigrade, and ester-interchange is allowed to occur for 77 minutes until 8.0 pounds of methanol (which is 97 percent of the theoretical amount of methanol) are evolved. Thereafter, the reaction mixture is transferred to an autoclave, 11.4 grams of triphenylphoshite sequestrant and 11.4 grams of titanium dioxide delustrant are added thereto, and it is subjected to a temperature of about 250° centigrade while an absolute pressure of from about 0.08 to about 0.35 millimeters of mercury is imposed over a period of 60 minutes. After this reduced pressure is reached, polycondensation is allowed to occur for a period of 140 minutes until a polymer with a relative viscosity of 25.4 is produced.

The polymer is dried and then extruded and spun at a spinning temperature of about 255° centigrade and a windup speed of 3500 feet per minute; during extrusion the filaments are subjected to outflow air quench at the rate of 15 cubic feet per minute, spinning threadline tension is maintained at about 0.19 grams per extruded filament, and 36 filaments are extruded. The spun yarn has a total denier of 430, a birefringence of from about 0.050 to about 0.065, and a boiling water shrinkage of from about 0 to about 1 percent.

The spun yarn is drawn over a heated feed roll at a temperature of 110° centigrade to a draw ratio of about 2.82; the draw speed used is 1804 feet per minute. The drawn yarn has a denier of 150, a tenacity of 3.4 grams/denier, an elongation of 35 percent, and a boiling water shrinkage of about 13 percent. The Uster value is 0.5%, and the yarn dyes very uniformly.

EXAMPLE 2.

Poly (tetramethylene) terephthalate is polymerized to a relative viscosity of 21.1 using zinc acetate as the polymerization catalyst. The chip is dried under vacuum, and 36 filaments are extruded at a spinning temperature of 265° centigrade and a windup speed of 3000 feet per minute; spinning threadline tension is maintained at 0.125 grams per filament. The resulting spun product is cold drawn 8 percent before being drawn an additional 250 percent from a heated roll maintained at 115° centigrade. The drawn product possesses good tensile strength and excellent dye uniformity.

EXAMPLE 3

In substantial accordance with Example 2, poly (tetramethylene) terephthalate is polymerized to a relative viscosity of 23.9 and melt spun at a spinning temperature of 255° centigrade and a windup speed of 2500 feet per minute; tension in the spinning threadline is maintained at less than about 0.09 grams per filament. After approximately 15 minutes, the yarn begins to crystallize on the bobbin preventing further takeup and utilization of the material on the package.

EXAMPLE 4

In substantial accordance with Example 2, poly (tetramethylene) terephthalate is polymerized to a relative viscosity of 25.4. The polymer is dried under vacuum, and 24 filaments are extruded at a spinning temperature of 255° centigrade and a windup speed of 4500 feet per minute; spinning threadline tension is 0.28 grams per filament, and spun denier is 82. The yarn is predrawn 1 percent from a cold roll and subsequently extended 203% from a roll heated to 110° centigrade. Yarn thus produced has good tensile properties and may be knitted into a tricot fabric having pleasing aesthetics and good dimensional stability.

Although applicant has very specifically described many aspects of his invention, many other modifications will suggest themselves to those skilled in the art upon a reading of this disclosure. These are intended to be comprehended within the scope of this invention.

What is claimed is:

1. A process for preparing yarn comprised of a polymer of at least 85 percent (by weight) of poly (tetramethylene) terephthalate with a spun denier per filament of from about 0.6 to about 50, comprising the steps of sequentially:

a. preparing a polymer comprised of at least 85 percent (by weight) of poly (tetramethylene) terephthalate wherein said polymer has a relative viscosity of from about 10 to about 50;

b. extruding the filaments of said polymer through a spinnerette, wherein:

1. the spinning temperature is from about 240 to about 280° centigrade, and
2. the extruded filaments are taken up at a windup speed of from about 1000 to about 10,000 feet per minute; and c. thereafter drawing said filaments to a draw ratio of from about 1.0 to about 5.0, said filaments being passed over a heated object comprising a pin or plate at a temperature of from about 60 to about 180 ° centigrade during said drawing step;

provided that, during said extrusion step, the spinning threadline tension per extruded filament (as measured about 70 inches from the face of the spinnerette) is at least 0.09 grams per filament, and the total spinning threadline tension (i.e., the tension on the yarn bundle) is at least $-0.4 + 0.00174$ (total spun denier of yarn) + 0.052 (relative viscosity of polymer) − 0.0366 (spinning temperature, in degrees centigrade) + 0.1414 (number of filaments extruded) + 0.00381 (windup speed in feet per minute) − 0.000000332 (windup speed in feet per minute)$^2$.

2. The process of claim 1, wherein:

a. 1.000 is greater than 1.603 − 0.0000174 (windup speed, feet/minute) + 0.0001336 (spinning temperature, degrees centigrade) + 0.003863 (heated object temperature, degrees centigrade) − 0.02377 (relative viscosity of polymer) + 0.0006562 (number of filaments extruded) − 0.0919 (heated object temperature in degrees centigrade/relative viscosity), b. said filaments are drawn in one stage to said draw ratio of from about 1.0 to about 5.0 while being passed over a heated object comprising a pin or plate at a temperature of from about 60° to about 180° centigrade, and c. said spinning threadline tension is at least 0.19 grams per filament and at least equal to 0.16 + 0.0005 (heated object temperature, degrees centigrade) grams per filament.

3. The process of claim 2, wherein:

a. the spun denier per filament of the yarn bundle is from about 1.8 to about 45;

b. said polymer has a relative viscosity of from about 15 to about 40 and the filaments of said polymer are extruded through a spinnerette, wherein:

1. the spinning temperature is from about 245° to about 270° centigrade, and
2. the extruded filaments are taken up at the windup speed of from about 2500 to about 6000 feet per minute; and c. thereafter said filaments are drawn in a draw ratio of from about 1.5 to aboout 4.5 in a single stage while being passed over a heated object comprising a pin or plate at a temperature of from about 70 to about 150° centigrade.

4. The process of claim 3, wherein:

a. the spun denier per filament of said yarn bundle is from about 1.8 to about 45;

b. said polymer has a relative viscosity of from about 20 to about 30 and the filaments of said polymer are extruded through a spinnerette, wherein:

1. the spinning temperature is from about 250° to about 265° centigrade, and 2. the extruded filaments are taken up at a windup speed of from about 3000 to about 5000 feet per minute; and c. thereafter said filaments are drawn while being passed over a heated object comprising a pin or plate at a temperature of from about 80 to about 130° centigrade.

* * * * *